United States Patent [19]

Sundin

[11] 3,977,627

[45] Aug. 31, 1976

[54] WINDING AND SLITTING APPARATUS

[75] Inventor: George Holger Sundin, Duluth, Minn.

[73] Assignee: Conwed Corporation, St. Paul, Minn.

[22] Filed: June 25, 1973

[21] Appl. No.: 372,802

[52] U.S. Cl. ..... 242/56.3; 242/56.7; 242/65

[51] Int. Cl.[2] ..... B65H 17/08; B65H 35/02

[58] Field of Search ..... 242/56.7, 56.2, 56.3, 242/56.6, 56 R, 58.6, 56.8, 65, 66, 56.9

[56] References Cited

UNITED STATES PATENTS

| | | | |
|---|---|---|---|
| 365,796 | 7/1887 | Colley | 242/56.3 |
| 837,340 | 12/1906 | Post | 242/56.3 |
| 2,414,739 | 1/1947 | Heygel | 242/56.3 X |
| 3,058,685 | 10/1962 | Kistler | 242/56.7 |
| 3,176,928 | 4/1965 | Saunders | 242/58.6 |
| 3,494,149 | 2/1970 | Gross | 242/56.3 X |
| 3,585,779 | 6/1971 | Thayer | 242/74 X |
| 3,633,840 | 1/1972 | Clark | 242/56 R |

*Primary Examiner*—Stanley N. Gilreath
*Assistant Examiner*—John M. Jillions
*Attorney, Agent, or Firm*—Eyre, Mann, Lucas & Just

[57] ABSTRACT

A device for winding and slitting rollable materials is disclosed. The device both winds and cuts the material simultaneously whereby evenly cut rolled material is obtained.

6 Claims, 4 Drawing Figures

WINDING AND SLITTING APPARATUS

The present invention relates to an apparatus for simultaneously winding and slitting rollable materials.

Sheets of material such as felt, textile fabrics, plastics and the like are usually rolled on cylinders for ease of handling, reduced storage, and a variety of other well known reasons. Frequently, it is necessary to trim the edges of the sheet material in order to remove undesirable edgings which may occur in the process of manufacturing the sheet material. In other cases, it is frequently desirable to cut the sheet material into thin strips and then roll the thin strips of material. Both of these cutting operations involve a number of problems. Since the cutting of the sheet material and the winding are separate operations, separate equipment for each operation is required and, of course, space is needed for these separate operations. Additionally, where it is desired to cut the sheet material into narrow strips and then wind it, very expensive guiding equipment is required as is sophisticated roll starting equipment. Accurate winding of thin strips of material is virtually impossible even with the most expensive equipment if the material varies in thickness from side to side. Additionally, even with the best of cutting machines, it is difficult to maintain uniform width of the stripped material.

In accordance with the present invention these disadvantages are overcome by an apparatus which combines the rolling and slitting operation. The sheet material is fed onto a mandrel which is continuously rotated by a drive roll which drives the sheet material. A fixed cutting means is provided which is continuously in contact with at least the outer layer of the sheet material being wound.

While the present invention is being described with respect to the cutting of the material to form separate strips, it will be understood that the apparatus could be equally well employed for the purpose of cutting into a surface layer without cutting through it whereby a partially cut rolled material would be obtained. This can be of advantage, for example, where it is desired to have a continuous roll with strips which can be separated on an as needed basis.

These and other advantages of the present invention may be more fully understood with reference to the figures in which.

Figure 1:
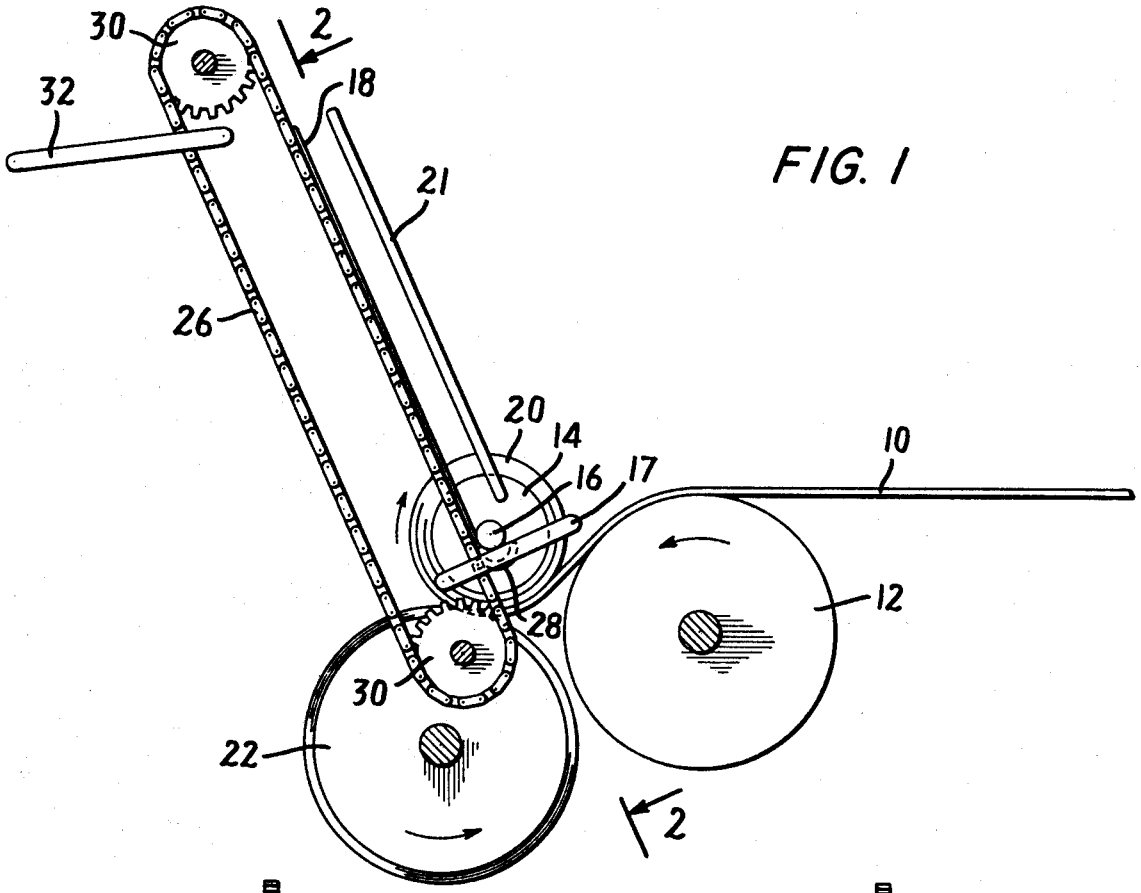
FIG. 1 is a side view of the apparatus of the present invention.

In FIG. 1 there is shown a sheet material 10 advancing over a drive roll 12 and onto a wind-up mandrel 14 having a spindle 16 as shown. It will be understood that it is not necessary to have a separate mandrel and spindle but that the present invention can be carried out solely with the spindle.

Figure 2:
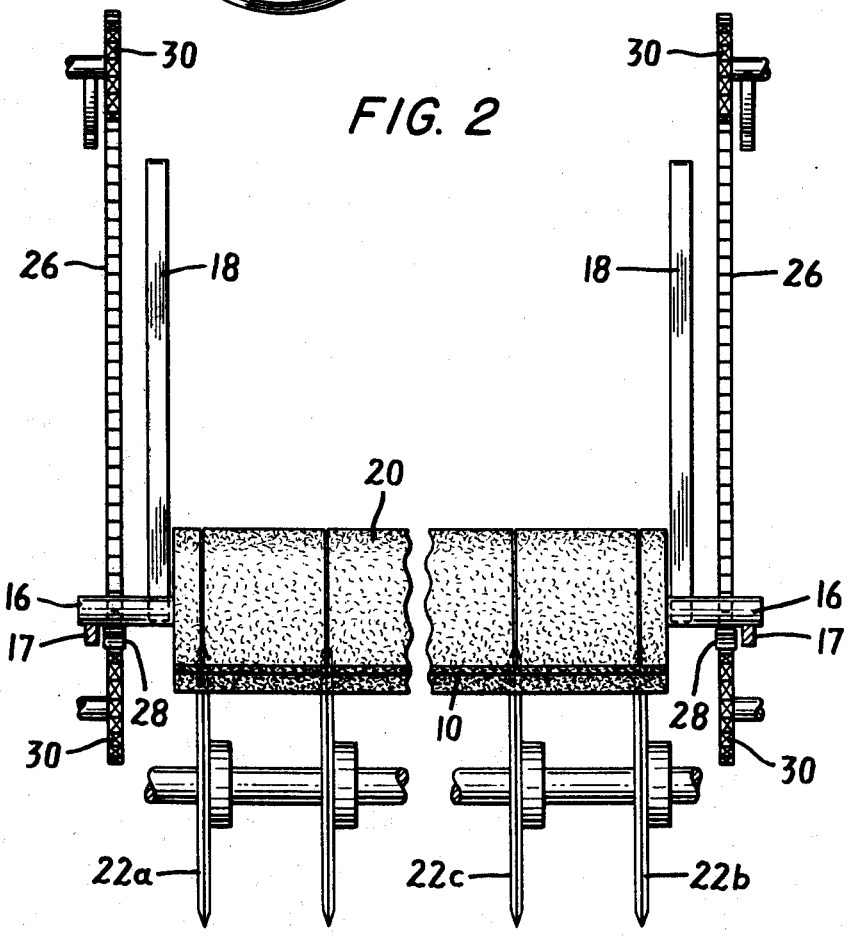
FIG. 2 is a front view of the apparatus of the present invention from the right side of FIG. 1.

As can be more clearly seen in FIG. 2, spindle 16 bears against guides 18. As the wound-up roll of material 20 increases in size, the spindle 16 will be positioned in successively higher locations on guides 18. It will therefore be understood that spindle 16 is not affixed to guides 18. There could, of course, be a retaining member in front of the spindle as shown at 21 in order to confine the spindle between the guides 18 and the retaining member 21. In the preferred embodiment of the invention, however, the guides 18 are at an acute angle from the vertical in a direction away from the drive roll so that the spindle 16 and mandrel 14 are retained against the guides 18 by gravity. Cutting means 22 are provided for cutting at least the outer layer of the wound-up roll. In the embodiment shown, the cutting means comprises steel discs which rotate in the direction shown on the disc. It will be understood that the cutting means can be in a different form such as fixed knives, razor blades or the like. The position of the cutting means is adjustable with respect to how deep it cuts into the wound-up roll. It will be understood, however, that once the position of the cutting means is fixed it will always cut to the same depth in the wound-up roll. This is caused by the fact that the wound-up roll continuously moves higher on guides 18 due to the fixed relationship of the guides with respect to the winding roll 12.

Figure 3:
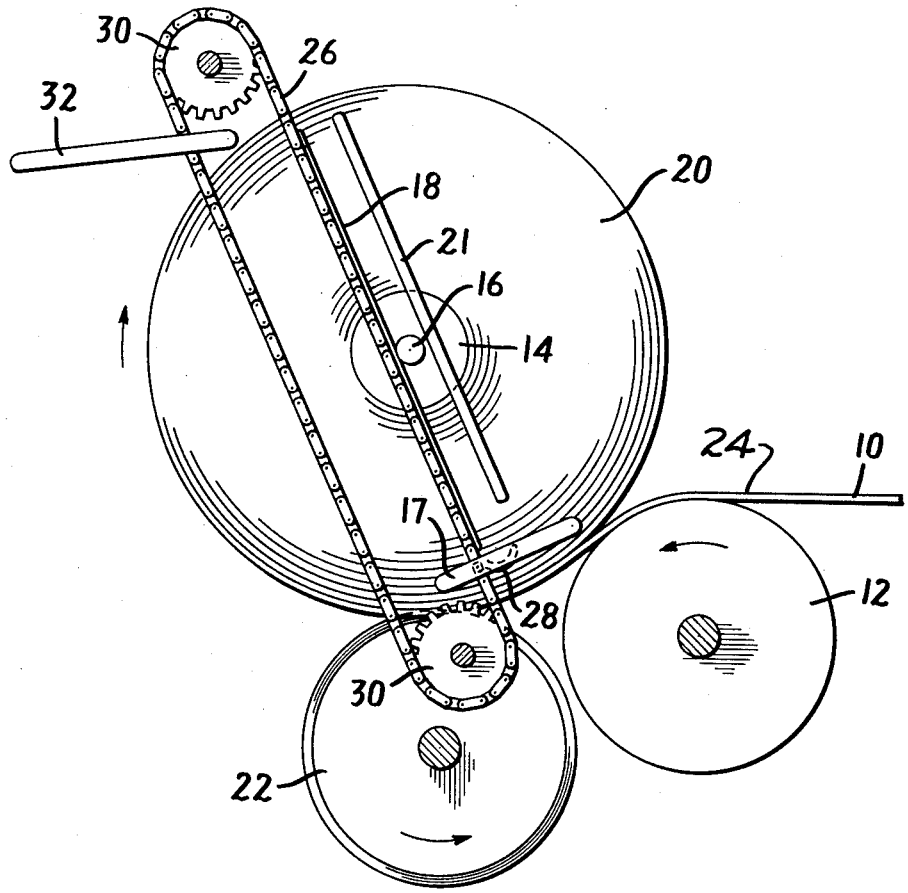
FIG. 3 is another side view of the apparatus of the present invention with a nearly completed rolled and slit sheet.

In FIG. 3 there is shown the same apparatus as in FIG. 1 except that the amount of material 10 on the wind-up mandrel 14 is considerably greater. In FIG. 2 there are shown three cutting means. 22*a* and 22*b* are trimming the edges from the roll and cutting means 22*c* is dividing the trimmed roll into two separate sections. As many cutting means 22 as desired may be used and it is not necessary to limit the number to three. As mentioned hereinbefore, in the preferred form of the invention the cutting blades comprise circular cutting wheels and are driven (by driving means not shown). In the preferred embodiment of the invention, all of the cutting means are driven at the same speed and on a common shaft. Where the cutting wheels are affixed to the shaft by adjustable means such as a screw, it is very simple to change the number of cutting wheels or to change the position of any one or more of the cutting wheels.

As the wound-up roll is shown in FIG. 3, it has reached just about the maximum size obtainable with the particular machine. It is therefore desirable to remove the roll from the cutting machine and this can be accomplished by severing the material 10 as for example at point 24 either by hand or with automatic cutting means. Thereafter, the entire roll can be lifted by chains 26 having receiving members 28 shaped for receiving and lifting the rolled-up material by means of spindle 16. The chain is suitably driven by sprocket 30 connected to driving means (not shown). After the roll reaches the top of the chain it will move forward by the force of gravity and can be collected at a receiving ramp 32 which can then deliver the wound and cut roll to any desired point. This means for removing the wound-up roll is of great advantage where the cylinder is quite heavy. It will be understood, however, that other means could be provided for removing the wound-up and cut roll and, in fact, the roll could even be removed by hand if desired.

Figure 4:
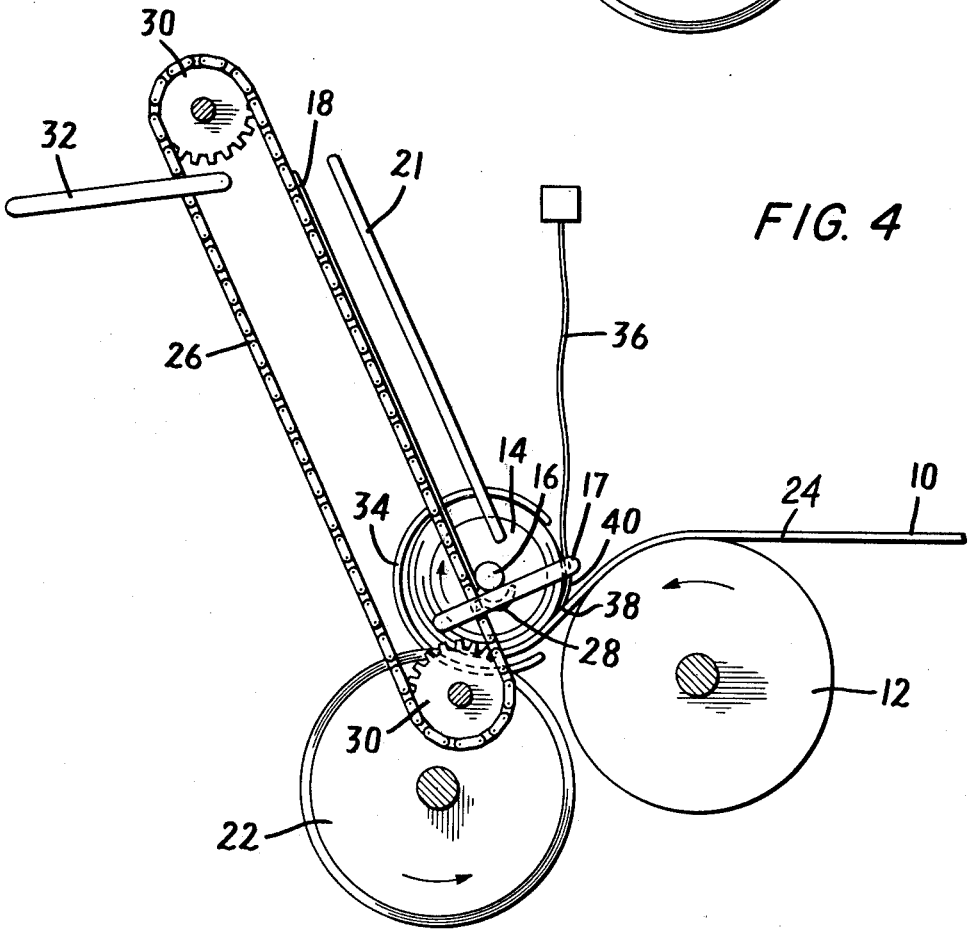
FIG. 4 is an apparatus according to the present invention for initiating wind-up of the sheet material.

Various means can be employed for starting the winding of the material 10 on the mandrel 14. In many applications it is suitable to start this winding by hand. However, we have found a very acceptable method to be the means shown in FIG. 4. As there shown, the leading edge of the material 10 advances through a cupped plate 34 which directs the material around the mandrel 14. The material thus directed is then fed back onto itself by means of strings 36 which extend into the crotch 38 between the material 10 and the mandrel 14. As will be understood by those skilled in the art, the string acts like little fingers in tucking the leading edge 40 of the material 10 onto the mandrel 14. After the material has started to collect on mandrel 14, the cupped plate 34 and the strings 36 can be moved to a position where they will not interfere with the balance of the operation. Suitably, the strings can be lifted up and the cupped plate 34 is moved back away from the roll 20. Cutting wheel 22 may be in operating position during this initial phase in order to effect cutting of the initial part of the roll or it can be moved into position after the roll is started. Where the cutting blade is in position and cutting during the initial formation of the roll, it is preferred to have at least one string 36 for each of the separate strips of cut material since this will best facilitate the start-up of winding of all material. It will be understood, of course, that more than one string can be employed for each strip of material if desired.

If desired, the initial start-up apparatus can be separate from the winding and slitting apparatus. This is sometimes of advantage since the cupped plate can be maintained in fixed position and there is no need to move it out of the way as the size of the roll increases.

Where a circular cutting wheel is employed, the initial power to rotate the mandrel 14 and the spindle 16 can be supplied by the rotation of the cutting wheel. After the material is wound for a while, the roll will be lifted on guides 18 because of the fixed distance between drive roll 12 and guides 18. The power to rotate the roll 20 will then be transferred to the drive roll and, as the wound roll gets larger, the center of the roll will continue to advance up guides 18 as shown in FIG. 3. As mentioned hereinbefore, the outer layer will continue to remain in contact with the cutting knife throughout the cutting and winding operation and will thereby insure perfectly straight cut strips of material on the winding roll. It is not necessary to have the mandrel initially in contact with the slitter knife and, by proper positioning of the drive roll, the power to drive the mandrel 14 and the spindle 16 can be achieved from drive roll 12.

It will be understood that the claims are intended to cover all changes and modifications of the preferred embodiments of the invention, herein chosen for the purpose of illustration, which do not constitute departures from the spirit and scope of the invention.

What is claimed is:

1. Apparatus for simultaneously winding and cutting sheet material comprising:

a. wind-up means including a spindle;

b. a drive roll for advancing the sheet material toward the wind-up means;

c. means for driving the drive roll;

d. rotatable cutter means positioned after the drive roll and before the wind-up means operative to be rotated in the same direction as the drive roll, the cutter means being in an adjustably fixed position;

e. means for rotating the cutter means;

f. guide means for maintaining the wind-up means in position with respect to the drive roll and cutter means, the guide means comprising a first pair of spaced parallel guide members disposed in a first plane at an acute angle from the vertical and a second pair of spaced parallel retaining members disposed in a second plane spaced from and parallel to the first plane, the guide and retaining members being disposed in a direction away from the drive roll so that the wind-up spindle is continuously movably retained between the guide and retaining members by gravity and the movement of the wind-up means; and g. the relative positions of the drive roll, the cutter means and the guide and retaining members being such that the drive roll is spaced from the wind-up means at least during the starting of winding thereof and such that gravity maintains at least the outer layer of the material being wound in continuous contact with the cutter means such that rotation of the wind-up means is effected solely by rotation of the cutter means during the initial period of winding the wind-up means and as the size of the rolled material increases, the rolled material and wind-up means will move upwards between the guide and retaining members due solely to winding and gravitational forces, and be driven primarily by the drive roll.

2. The apparatus of claim 1 wherein the cutting means comprises at least one axially adjustable circular blade.

3. The apparatus of claim 1 further comprising automatic means for removing a completed roll from the winding and cutting apparatus.

4. The apparatus of claim 3 wherein the automatic means for removing the rolls comprises chains with receiving means for receiving the ends of the spindle of the wind-up means and lifting the wound roll above the top of the guide means.

5. The apparatus of claim 1 further comprising means for automatically starting the wind-up of the mandrel, which are operative to be used simultaneous with, and independent of, the cutting and winding operations of the apparatus.

6. The apparatus of claim 5 wherein the means for starting wind-up of the material comprise a cupped plate which wraps around the wind-up means and finger-like members which aid in tucking the material around the wind-up means.

* * * * *